US008642905B2

(12) United States Patent
Gottschalk et al.

(10) Patent No.: US 8,642,905 B2
(45) Date of Patent: Feb. 4, 2014

(54) CHARGING ASSEMBLY WITH OVER ROTATION CONTROL AND ELECTRICAL SWITCHING APPARATUS EMPLOYING SAME

(75) Inventors: Andrew Lawrence Gottschalk, Monaca, PA (US); Robert Michael Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 297 days.

(21) Appl. No.: 13/306,374

(22) Filed: Nov. 29, 2011

(65) Prior Publication Data

US 2013/0134020 A1 May 30, 2013

(51) Int. Cl.
*H01H 5/00* (2006.01)

(52) U.S. Cl.
USPC ..... 200/400; 200/401

(58) Field of Classification Search
USPC ..... 200/400, 401
See application file for complete search history.

(56) References Cited

U.S. PATENT DOCUMENTS

| | | | | |
|---|---|---|---|---|
| 6,437,269 | B1 * | 8/2002 | Rakus | 200/400 |
| 7,186,937 | B1 | 3/2007 | Ricciuti et al. | |
| 7,294,804 | B1 | 11/2007 | Gottschalk et al. | |
| 7,449,652 | B2 | 11/2008 | Rakus et al. | |
| 7,449,653 | B2 | 11/2008 | Gibson et al. | |
| 7,518,076 | B1 | 4/2009 | Gottschalk et al. | |
| 7,586,055 | B2 | 9/2009 | Jones et al. | |
| 7,687,733 | B2 | 3/2010 | Weister et al. | |
| 7,696,448 | B2 | 4/2010 | Rakus et al. | |
| 8,063,328 | B2 * | 11/2011 | Gottschalk et al. | 200/400 |
| 2008/0237014 | A1 * | 10/2008 | Wehrli et al. | 200/400 |
| 2008/0237015 | A1 | 10/2008 | Rakus et al. | |
| 2008/0237016 | A1 | 10/2008 | Gibson et al. | |
| 2011/0062006 | A1 * | 3/2011 | Gottschalk et al. | 200/337 |

OTHER PUBLICATIONS

International Search Report and Written Opinion for International Application No. PCT/US2012/064594, issued Feb. 14, 2013.

* cited by examiner

*Primary Examiner* — Renee Luebke
*Assistant Examiner* — Ahmed Saeed
(74) *Attorney, Agent, or Firm* — Eckert Seamans Cherin & Mellott, LLC; Grant E. Coffield

(57) ABSTRACT

A charging assembly is provided for an electrical switching apparatus, such as a circuit breaker. The circuit breaker includes a housing, separable contacts, and an operating mechanism for opening and closing the separable contacts. The charging assembly includes a stored energy mechanism, such as a closing spring, which is movable between charged and discharged positions. A cast member is coupled to the closing spring and moves therewith. The cast member includes a projection. A cam shaft is pivotably coupled to the housing, and includes a number of cams. A catchment, which is also pivotably coupled to the housing, includes an impact surface and a protrusion. The impact surface cooperates with a corresponding one of the cams to resist over rotation of the cam shaft. The protrusion of the catchment cooperates with the projection of the cast member to maintain the desired relationship between the catchment and the cam.

20 Claims, 4 Drawing Sheets

CHARGING ASSEMBLY WITH OVER ROTATION CONTROL AND ELECTRICAL SWITCHING APPARATUS EMPLOYING SAME

BACKGROUND

1. Field

The disclosed concept relates generally to electrical switching apparatus and, more particularly, to charging assemblies for electrical switching apparatus. The disclosed concept also relates to electrical switching apparatus, such as circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a poleshaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the poleshaft. Elements of both the closing assembly and the opening assembly, which are also pivotably coupled to the poleshaft, pivot the poleshaft in order to effectuate the closing and opening of the electrical contacts. A charging assembly, which includes a number of stored energy mechanisms, is often employed to facilitate operation of the closing assembly.

As shown, for example, in FIGS. 1A and 1B, some circuit breakers 2 have direct drive stored energy mechanisms such as, for example and without limitation, a number of closing springs 4 (one closing spring 4 is partially shown in simplified form in FIG. 1A). The charging assemblies 6 of such circuit breakers 2 typically include a cam shaft 8 having a number of cams 10,12, and a catchment 14. The catchment 14 in the example of FIGS. 1A and 1B is pivotably coupled to a side plate 16 of the circuit breaker 2. In such devices, the spring assembly, which includes the aforementioned closing spring(s) 4 and a spring casting 18 biased by the spring(s) 4, is charged by action of the cam shaft 8, and is released so the discharged spring 4 directly drives the main toggle links (not shown) of the closing assembly. As the spring 4 discharges, the catchment cam 12, which has been released, continues to rotate in the charging direction (e.g., counterclockwise in the direction of arrow 20 from the perspective of FIG. 1A). If it rotates far enough, it can interfere with the discharge of the spring 4 and prevent the circuit breaker 2 from completely closing. This undesirable condition is generally referred to as cam shaft over rotation. Although the catchment 14 is generally structured to cooperate with the cam(s) 12 to resist such over rotation of the cam shaft 8, it is possible, particularly after extended use, that the impact surface 22 of the catchment 14 and/or the corresponding catchment surface 24 of the catchment cam 12 can become worn or damaged (see, for example, damaged or deformed surfaces 22',24' in FIG. 1B), causing the catchment to be less effective.

There is, therefore, room for improvement in charging assemblies, and in electrical switching apparatus, such as circuit breakers, which employ charging assemblies.

SUMMARY

These needs and others are met by embodiments of the disclosed concept, which are directed to a charging assembly for an electrical switching apparatus, such as a circuit breaker. Among other benefits, the charging assembly includes a catchment that cooperates with the closing spring casting to control movement (e.g., resist over rotation) of the cam shaft.

As one aspect of the disclosed concept, a charging assembly is provided for an electrical switching apparatus. The electrical switching apparatus includes a housing, separable contacts enclosed by the housing, and an operating mechanism for opening and closing the separable contacts. The charging assembly comprises: a stored energy mechanism movable between a charged position and a discharged position; a cast member coupled to the stored energy mechanism and being movable therewith, the cast member including a projection; a cam shaft structured to be pivotably coupled to the housing, the cam shaft including a number of cams; and a catchment structured to be pivotably coupled to the housing, the catchment comprising an impact surface and a protrusion. The impact surface of the catchment cooperates with a corresponding one of the cams to resist over rotation of the cam shaft. The protrusion of the catchment cooperates with the projection of the cast member to maintain the desired relationship between the catchment and the corresponding one of the cams.

The catchment may further comprise a pivot member, a first portion, a second portion, and a third portion. The pivot member may be structured to pivotably couple the first portion to the housing of the electrical switching apparatus, the second portion may cooperate with the corresponding one of the cams, and the third portion may cooperate with the projection of the cast member. The impact surface may be disposed on the second portion of the catchment, and the protrusion may be disposed on the third portion of the catchment, wherein the protrusion extends outwardly from the catchment proximate the impact surface. The catchment may be a single piece member, wherein the protrusion is a generally rectangular-shaped portion extending outwardly from the third portion of the single piece member. The protrusion may have an outer edge wherein, when the impact surface of the catchment engages the corresponding one of the cams, the outer edge of the protrusion cooperates with the projection of the cast member.

The cast member may be a single piece spring casting, and the projection may project laterally outwardly from the single piece spring casting and include a retaining edge. The retaining edge of the single piece spring casting may retain the outward edge of the catchment, thereby preventing the impact surface of the catchment from releasing the corresponding one of the cams.

As another aspect of the disclosed concept, an electrical switching apparatus employing the aforementioned charging assembly is disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
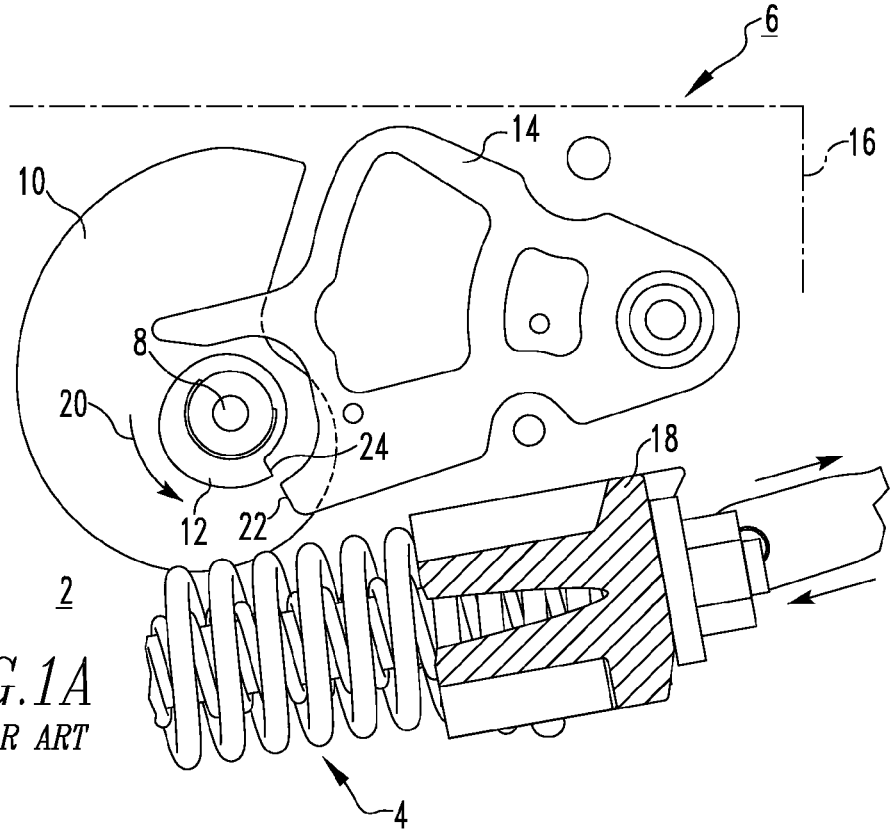
FIG.1A PRIOR ART
FIGS. 1A and 1B are simplified side elevation views of a portion of a prior art circuit breaker and charging assembly therefor.

Directional phrases used herein, such as, for example, clockwise, counterclockwise, left, right, upward, downward and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
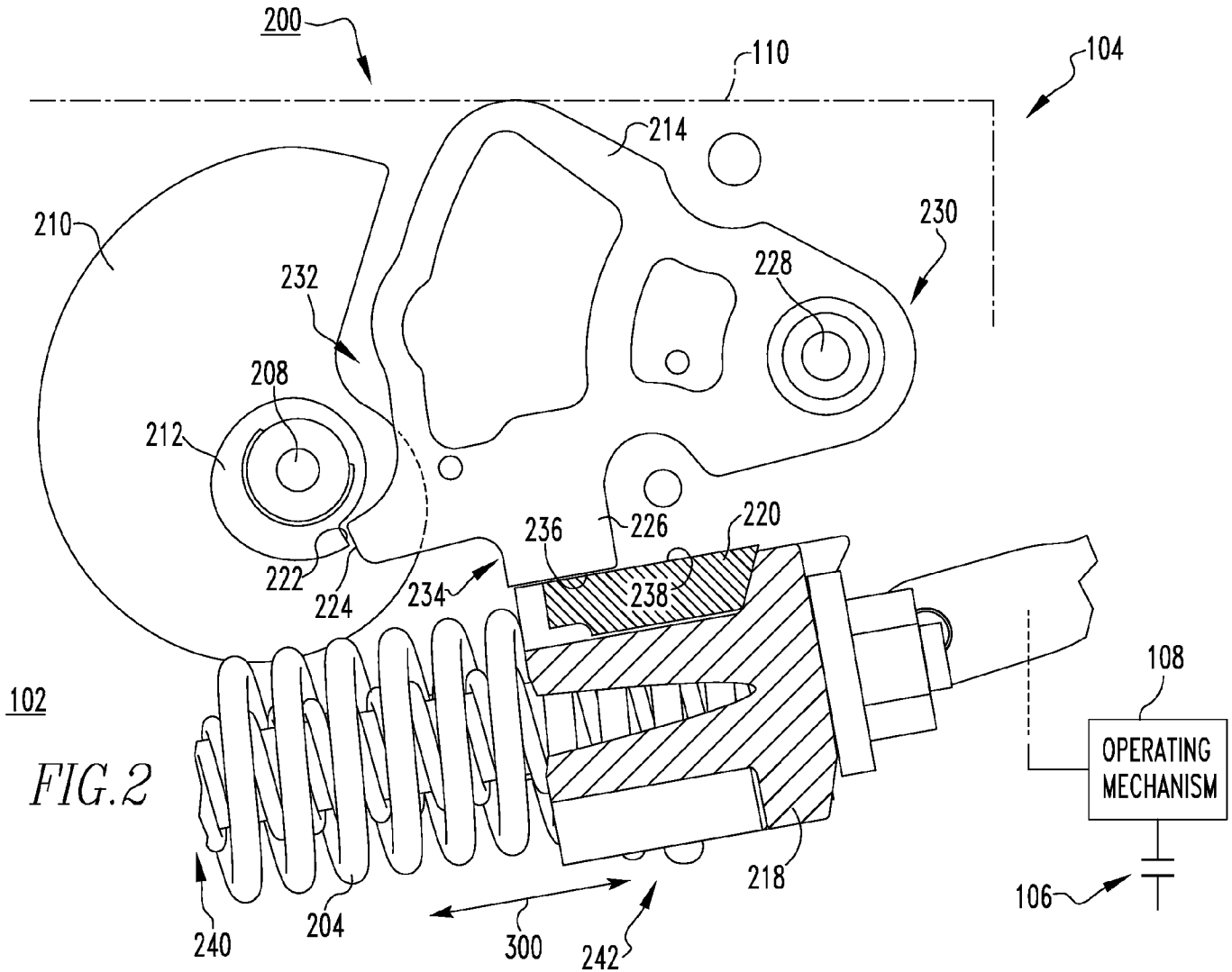
FIG. 2 is a simplified side elevation view of a portion of a circuit breaker and a charging assembly therefor, in accordance with an embodiment of the disclosed concept.

FIGS. 2-7 show a charging assembly 200 for an electrical switching apparatus, such as for example and without limitation, a circuit breaker 102. The circuit breaker 102 includes a housing 104, separable contacts 106 (shown in simplified form in FIG. 2) enclosed by the housing 104, and an operating mechanism 108 (shown in simplified form in FIG. 2) for opening and closing the separable contacts 106 (FIG. 2).

Figure 4:
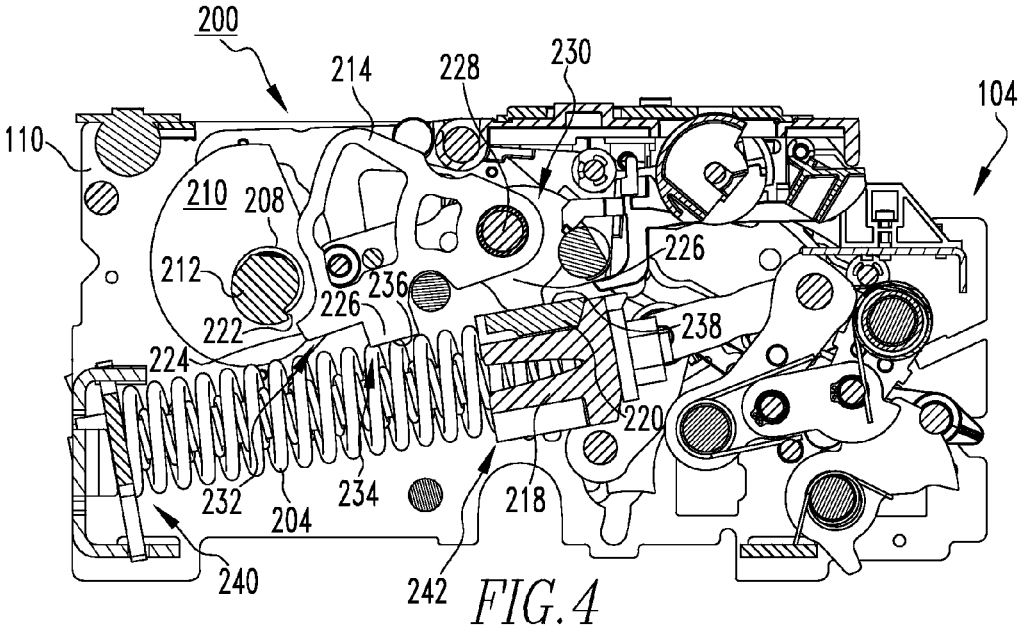
FIG. 4 is a section view taken along line 4-4 of FIG. 3, with the circuit breaker shown in the discharged and tripped position.
Figure 7:
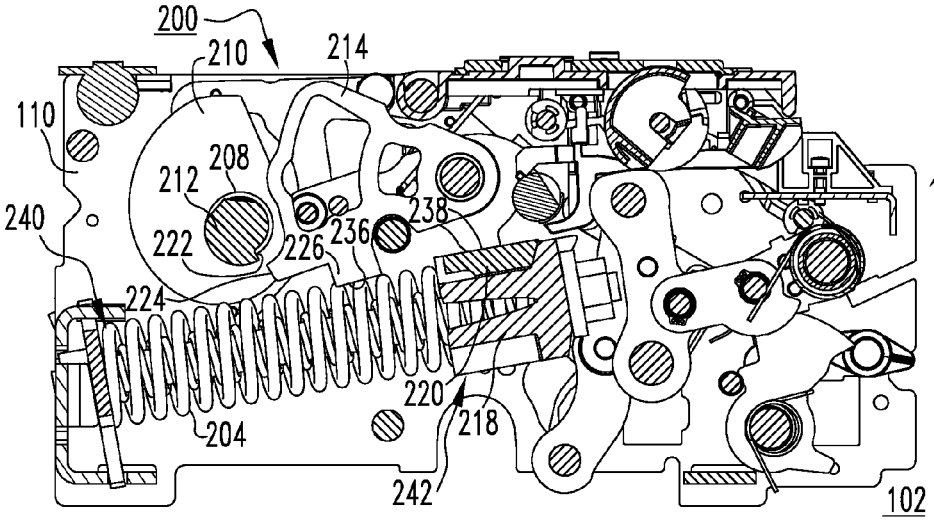
FIG. 7 shows the section view of FIG. 6, but modified to show the circuit breaker in the discharged and closed position.

As best shown in FIG. 2, the charging assembly 200 preferably includes a stored energy mechanism, such as for example and without limitation a closing spring 204 (partially shown in FIG. 2), which is movable between a charged position (FIG. 5) and a discharged position (FIGS. 2, 4 and 7). A cast member 218 is coupled to the closing spring 204 and is movable therewith (e.g., without limitation, left and right in the direction of arrow 300 from the perspective of FIG. 2). The cast member 218 includes a projection 220. A cam shaft 208 is pivotably coupled to the circuit breaker housing 104, and includes a number of cams 210,212 (two are shown in the example shown and described herein). A catchment 214, which is also pivotably coupled to the housing 104, includes an impact surface 224 and a protrusion 226. As will be described in greater detail hereinbelow, the impact surface 224 of the catchment 214 cooperates with a corresponding one of the cams 212 and, in particular, a catchment surface 222 of the cam 212, to resist over rotation of the cam shaft 208. Additionally, in accordance with the disclosed concept, the aforementioned protrusion 226 of the catchment 214 cooperates with the projection 220 of the cast member 218 to maintain a desired relationship between the catchment 214 and cam 212.

Figure 1B:
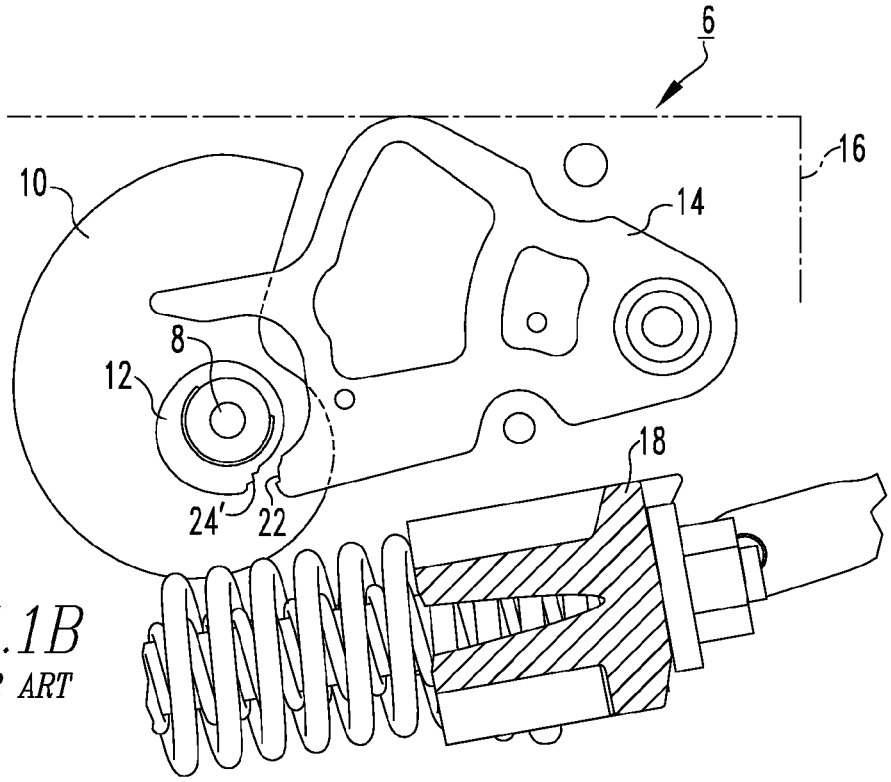
FIG.1B PRIOR ART

Accordingly, it will be appreciated that, among other benefits, the projection 220 and protrusion 226 features of the disclosed concept, function to augment operation of the catchment 214 by interlocking the catchment 214 with the spring casting 218 in a manner which prevents glancing collision, for example, that could otherwise occur between the catchment surface 222 of cam 212 and impact surface 224 of catchment 214. In this manner, the disclosed charging assembly 200 provides a back-up mechanism for resisting over rotation of the cam shaft 208 and damage associated therewith. For example and without limitation, issues such as breaker vibration can cause prior art catchments (see, for example and without limitation, catchment 14 of FIGS. 1A and 1B) to move to a position (see, for example, FIG. 1B) that allows cam shaft over rotation. Additionally, it is possible that late in life (i.e., after extended use) the catchment collision feature (e.g., without limitation, see surface 24 of catchment 14 of FIG. 1A) and/or the mating cam shaft feature (see, for example, cam shaft surface 22 of FIG. 1A) can become damaged (see, for example, deformed surfaces 22',24' of FIG. 1B) in a manner that allows a glancing blow or impact that leads to cam shaft over rotation. The disclosed concept improves upon operation of the catchment 214, thereby addressing and preventing these potential problems.

More specifically, the catchment 214 in the non-limiting example shown and described herein, preferably includes a pivot member 228, a first portion 230, a second portion 232, and a third portion 234. The pivot member 228 pivotably couples the first portion 230 to the circuit breaker housing 104 and, in particular, to a side plate 110 (partially shown in hidden line drawing in FIG. 2) thereof, as best shown in FIG. 2. The second portion 232 cooperates with cam 212, and the third portion 234 cooperates with the projection 220 of the cast member 218. In the example shown and described herein, the impact surface 224 is disposed on the second portion 232 of the catchment 214, and the protrusion 226 is disposed on a third portion 234 of the catchment 214. Accordingly, the protrusion 226 extends outwardly from the catchment 214 proximate the impact surface 224, as shown. Continuing to refer to FIG. 2, and also to FIGS. 4-7, the catchment 214 is preferably a single piece member, wherein the protrusion 226 is a generally rectangular-shaped portion that extends outwardly from the third portion 234 thereof.

As best shown in FIG. 2, the protrusion 226 has an outer edge 236. When the impact surface 224 of the catchment 214 engages a corresponding cam 212 and, in particular, catchment surface 222 thereof, or is in close proximity thereto (see, for example, FIGS. 2, 5 and 6), the outer edge 236 of the protrusion 226 cooperates with the aforementioned projection 220 of the cast member 218.

Figure 5:
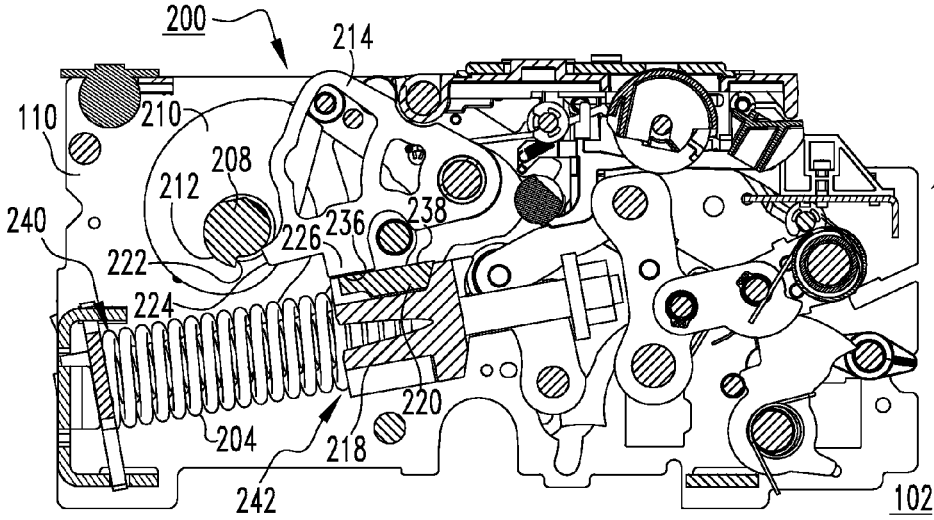
FIG. 5 shows the section view of FIG. 4, but modified to show the circuit breaker in the charged and open position.
Figure 6:
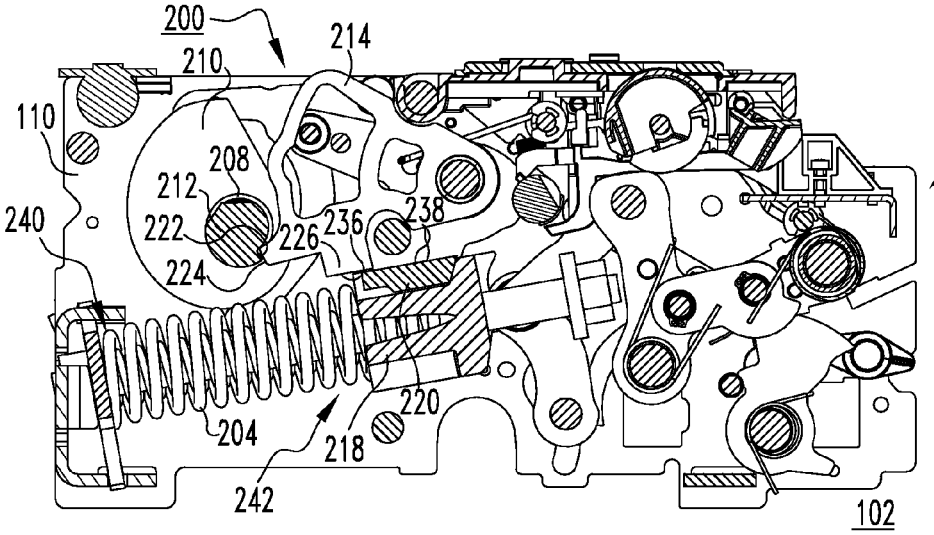
FIG. 6 shows the section view of FIG. 5, but modified to show the circuit breaker when the circuit breaker is in the process of closing and the spring casting is in position to stop the catchment.

The cast member 218 is preferably a single piece spring casting, wherein the projection 220 projects laterally outwardly from the single piece spring casting 218 and includes a retaining edge 238. The retaining edge 238, therefore, retains the outward edge 236 of the catchment 214, as shown in FIGS. 2, 5 and 6, thereby preventing the impact surface 224 of the catchment 214 from fully releasing the corresponding cam 212 and/or preventing the aforementioned cam shaft over rotation and/or glancing collision (e.g., impacting and bouncing off of) issues between the surfaces 222,224 of the cam 212 and catchment 214, respectively. It will be appreciated that while the projection 220 of the example spring casting 218 is a cast feature on the single piece spring casting 218, any known or suitable alternative type, shape and/or configuration of projection (not shown) could be employed to properly cooperate with a feature (e.g., without limitation, protrusion 226) of the catchment to suitably control movement of the catchment 214 without departing from the scope of the disclosed concept. For example and without limitation, relatively more complicated couplings (not shown) are possible, such as a catchment-secured pin (not shown) in a slot (not shown) in the spring casting 218, or a linkage assembly (not shown).

As previously discussed hereinabove, the example stored energy mechanism is a closing spring 204. The closing spring 204 has opposing first and second ends 240,242 (FIGS. 2 and 4-7). The spring casting 218 is disposed on the second end 242 of the closing spring 204 and moves therewith in the direction of arrow 300, as shown in FIG. 2. The example cam shaft 208 includes a first cam, which is a charging cam 210 that pivots with the cam shaft 208 to charge the closing spring 204, and a second cam, which is a catchment cam 212 that also pivots with the cam shaft 208 to engage and disengage the impact surface 224 of the catchment 214, as previously discussed.

Figure 3:
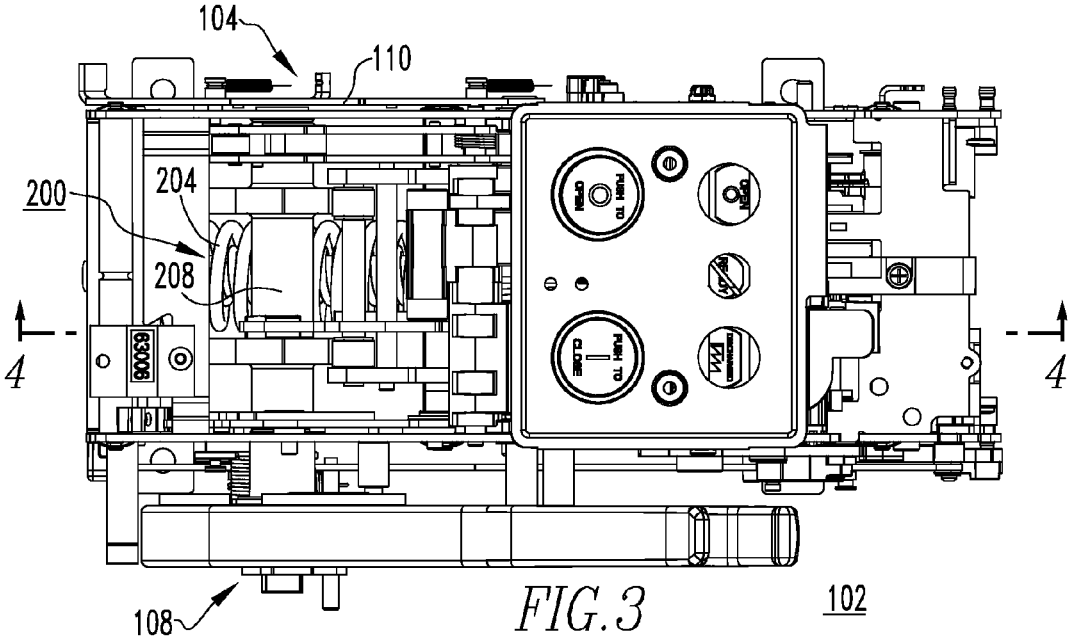
FIG. 3 is top plan view of the circuit breaker and charging assembly.

FIGS. 4-7 show section views of the circuit breaker 102 of FIG. 3 to illustrate the charging assembly 200 during various operational states of the circuit breaker 102. More specifically, FIG. 4 shows the circuit breaker 102 in the discharged and tripped state, FIG. 5 shows the circuit breaker in the charged and opened state, FIG. 6 shows the circuit breaker 102 in the process of closing, wherein the spring casting 218 is in position to stop the catchment 214 if it is forced downward (from the perspective of FIG. 6), for example, due to excessive cam shaft rotational force, and FIG. 7 shows the circuit breaker 102 in the discharged and closed state.

Accordingly, it will be appreciated that the disclosed charging assembly 200 includes unique catchment 214 and spring casting 218 features (e.g., without limitation, projection 220 of spring casting 218, and protrusion 226 of catchment 214), which interact to prevent the cam shaft 208 from slipping past (e.g., over rotating) the catchment 214 until the spring casting 218 is sufficiently close to the completely closed position. Therefore, the disclosed concept functions to augment catchment operation by interlocking the catchment 214 with the spring casting 218 in a manner that prevents glancing collisions and/or damage to the cam 212 and catchment 214 that can cause cam shaft over rotation.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A charging assembly for an electrical switching apparatus, said electrical switching apparatus including a housing, separable contacts enclosed by the housing, and an operating mechanism for opening and closing said separable contacts, said charging assembly comprising:

a stored energy mechanism movable between a charged position and a discharged position;

a cast member coupled to the stored energy mechanism and being movable therewith, said cast member including a projection;

a cam shaft structured to be pivotably coupled to the housing, said cam shaft including a number of cams; and a catchment structured to be pivotably coupled to the housing, said catchment comprising an impact surface and a protrusion, wherein the impact surface of said catchment cooperates with a corresponding one of said cams to resist over rotation of said cam shaft, and wherein the protrusion of said catchment cooperates with the projection of said cast member to maintain the desired relationship between said catchment and said corresponding one of said cams.

2. The charging assembly of claim 1 wherein said catchment further comprises a pivot member, a first portion, a second portion, and a third portion; wherein said pivot member is structured to pivotably couple the first portion to the housing of said electrical switching apparatus; wherein the second portion cooperates with said corresponding one of said cams; and wherein the third portion cooperates with the projection of said cast member.

3. The charging assembly of claim 2 wherein said impact surface is disposed on the second portion of said catchment; wherein the protrusion is disposed on the third portion of said catchment; and wherein the protrusion extends outwardly from said catchment proximate the impact surface.

4. The charging assembly of claim 3 wherein said catchment is a single piece member; and wherein the protrusion is a generally rectangular-shaped portion extending outwardly from the third portion of said single piece member.

5. The charging assembly of claim 4 wherein the protrusion has an outer edge; and wherein, when the impact surface of said catchment engages said corresponding one of said cams, the outer edge of the protrusion cooperates with the projection of said cast member.

6. The charging assembly of claim 5 wherein said cast member is a single piece spring casting; wherein the projection projects laterally outwardly from said single piece spring casting and includes a retaining edge; and wherein the retaining edge of said single piece spring casting retains the outward edge of said catchment, thereby preventing the impact surface of said catchment from releasing said corresponding one of said cams.

7. The charging assembly of claim 1 wherein said stored energy mechanism is a closing spring; wherein said cast member is a spring casting; wherein said closing spring includes a first end and a second end disposed opposite and distal from the first end; and wherein said spring casting is disposed on the second end of said closing spring.

8. The charging assembly of claim 1 wherein said number of cams is a first cam and a second cam.

9. The charging assembly of claim 8 wherein said first cam is a charging cam; wherein said charging cam pivots with said cam shaft to charge said stored energy mechanism; wherein said second cam is a catchment cam; and wherein said catchment cam pivots with said cam shaft to engage and disengage the impact surface of said catchment.

10. The charging assembly of claim 9 wherein said catchment cam includes a catchment surface; and wherein the catchment surface cooperates with the impact surface of said catchment to resist movement of said cam shaft.

11. An electrical switching apparatus comprising:

a housing;

separable contacts enclosed by the housing;

an operating mechanism for opening and closing said separable contacts; and a charging assembly comprising:

a stored energy mechanism movable between a charged position and a discharged position, a cast member coupled to the stored energy mechanism and being movable therewith, said cast member including a projection, a cam shaft structured pivotably coupled to the housing, said cam shaft including a number of cams, and a catchment pivotably coupled to the housing, said catchment comprising an impact surface and a protrusion, wherein the impact surface of said catchment cooperates with a corresponding one of said cams to resist over rotation of said cam shaft, and wherein the protrusion of said catchment cooperates with the projection of said cast member to maintain the desired relationship between said catchment and said corresponding one of said cams.

12. The electrical switching apparatus of claim 11 wherein said catchment of said charging assembly further comprises a pivot member, a first portion, a second portion, and a third portion; wherein said pivot member pivotably couples the first portion to the housing; wherein the second portion cooperates with said corresponding one of said cams; and wherein the third portion cooperates with the projection of said cast member.

13. The electrical switching apparatus of claim 12 wherein said impact surface is disposed on the second portion of said catchment; wherein the protrusion is disposed on the third portion of said catchment; and wherein the protrusion extends outwardly from said catchment proximate the impact surface.

14. The electrical switching apparatus of claim 13 wherein said catchment is a single piece member; and wherein the protrusion is a generally rectangular-shaped portion extending outwardly from the third portion of said single piece member.

15. The electrical switching apparatus of claim 14 wherein the protrusion has an outer edge; and wherein, when the impact surface of said catchment engages said corresponding one of said cams, the outer edge of the protrusion cooperates with the projection of said cast member.

16. The electrical switching apparatus of claim 15 wherein said cast member is a single piece spring casting; wherein the projection projects laterally outwardly from said single piece spring casting and includes a retaining edge; and wherein the retaining edge of said single piece spring casting retains the outward edge of said catchment, thereby preventing the impact surface of said catchment from releasing said corresponding one of said cams.

17. The electrical switching apparatus of claim 11 wherein said stored energy mechanism is a closing spring; wherein said cast member is a spring casting; wherein said closing spring includes a first end and a second end disposed opposite and distal from the first end; and wherein said spring casting is disposed on the second end of said closing spring.

18. The electrical switching apparatus of claim 11 wherein said number of cams is a first cam and a second cam; wherein said first cam is a charging cam; wherein said charging cam pivots with said cam shaft to charge said stored energy mechanism; wherein said second cam is a catchment cam; and wherein said catchment cam pivots with said cam shaft to engage and disengage the impact surface of said catchment.

19. The electrical switching apparatus of claim 18 wherein said catchment cam includes a catchment surface; and wherein the catchment surface cooperates with the impact surface of said catchment to resist movement of said cam shaft.

20. The electrical switching apparatus of claim 11 wherein said electrical switching apparatus is a circuit breaker; wherein the housing of said circuit breaker includes at least one side plate; and wherein said cam shaft and said catchment are pivotably coupled to said at least one side plate.

* * * * *